United States Patent [19]

Sinclair

[11] Patent Number: 4,467,894

[45] Date of Patent: Aug. 28, 1984

[54] FLUID POWER SYSTEM

[75] Inventor: Stuart W. Sinclair, Lake Jackson, Tex.

[73] Assignee: Anderson, Clayton & Co., Houston, Tex.

[21] Appl. No.: 339,550

[22] Filed: Jan. 15, 1982

[51] Int. Cl.[3] ..... B66B 11/04

[52] U.S. Cl. ..... 187/17; 187/9 R; 414/621; 91/531

[58] Field of Search ..... 187/17, 9 E, 9 R; 414/618, 620, 621; 91/525, 526, 530, 531, 518, 536

[56] References Cited

U.S. PATENT DOCUMENTS

| | | | |
|---|---|---|---|
| 3,692,198 | 9/1972 | Lake | 414/621 |
| 4,161,256 | 7/1979 | Seaberg | 414/620 |
| 4,286,692 | 9/1981 | Bauer et al. | 187/9 R |

*Primary Examiner*—Joseph J. Rolla
*Assistant Examiner*—Kenneth Noland
*Attorney, Agent, or Firm*—Fulbright & Jaworski

[57] ABSTRACT

A fluid power system for actuating three separately controllable double acting fluid motors each selectively providing a separate function in which the number of hydraulic lines to the motors is minimized. A first function valve supplies power to the first motor and a second function valve provides power to a selector valve which selectively connects the power to the second and third motors. The selector valve is pilot actuated from one of the lines to the first motor and a control valve supplies power to the one line for actuating the selector valve. The system is particularly useful for a lift truck for minimizing the number of hydraulic lines connected to the motors on the carriage of the truck.

8 Claims, 2 Drawing Figures

26
30
12
14
18
27
28
32
34
20
16
24
22
70
72
74
56
58
80
10
CARRIAGE
TRUCK
62
64
54
52
94
96
90
92
100
98
60
42
68
66
70
48
46
50
40
44

26a
30a
27a
28a
14a
12a
18a
32a
34a
20a
22a
24a
16a
58a
56a
170
172
174
80a
10a
CARRIAGE
TRUCK
62a
64a
52a
54a
100a
94a
96a
90a
98a
60a
42a
40a
68a
66a
70a
48a
46a
50a
44a

FLUID POWER SYSTEM

BACKGROUND OF THE INVENTION

The present invention is directed to an improved fluid power system for actuating three separately controllable double acting fluid motors which selectively provide separate functions. In particular, the present invention is directed to a conventional lift truck in which the motors are provided on the movable carriage and the controls are mounted on the truck body. Because of the movement of the carriage relative to the body, it is important to reduce the number of hydraulic fluid lines extending from the body to the carriage. Various power systems such as shown in U.S. Pat. Nos. 3,692,198 and 4,161,256 have been disclosed for solving this problem.

The present invention is directed to an improved fluid power system which reduces the number of hydraulic fluid lines between the control and the actuated motors to four and provides a more simple and easily operable system.

SUMMARY

The present invention is directed to a fluid power system having a fluid power source for activating three separately controllable double acting fluid motors each of which selectively provides a separate function and each of which has a pair of actuating fluid lines. A first function valve is connected between the power source and the pair of lines connected to the first motor for actuating the first motor. A second function valve is connected between the fluid source and a pair of power lines. A selector valve is connected to at least one of the power lines for receiving fluid therefrom and is connected to the second and third motors for selectively connecting one of the second and third motors to the power lines. A pilot control line is connected between one of the pair of lines to the first motor and to the selector valve for actuating the selector valve and a control valve is connected between the fluid source and said one of the pair of lines to the first motor for supplying fluid to and actuating a selector valve.

A still further object of the present invention is the present invention is the provision of a selector valve which is a six-way, two positioned hydraulically controlled pilot valve.

A still further object of the present invention is wherein the first motor is a clamping motor and the pilot control line to the selector valve is connected to the closing line of the first motor.

A still further object of the present invention is the provision of a power system for a lift truck in which three double acting fluid motors are connected to the movable carriage of the lift truck and the fluid power system has only four hydraulic lines connected between the body and the carriage. The first and second function valves and control valve are mounted on the body and the selector valve is mounted on the carriage. All of the actuating valves are mounted on the truck body and only four hydraulic lines extend to the motors and the selector valve.

Other and further objects, features and advantages will be apparent from the following description of a presently preferred embodiment of the invention given for the purpose of disclosure and taken in conjunction with the accompanying drawings.

DESCRIPTION OF THE PREFERRED EMBODIMENT

While the present invention may be useful in other applications, it is particularly useful and advantageous in connection with a lift truck and for purposes of illustration will be described in that connection.

Figure 1:
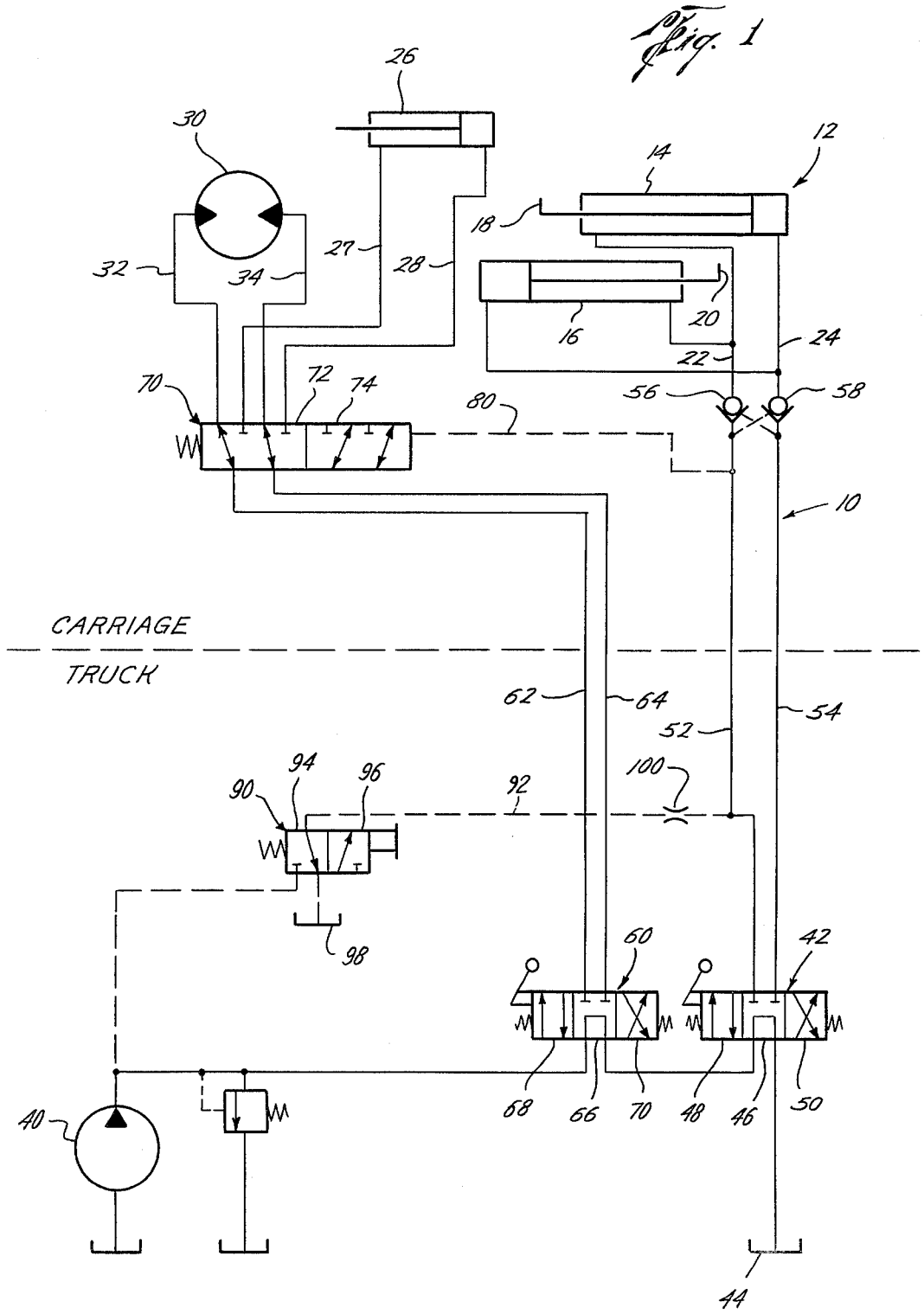
FIG. 1 is a schematic hydraulic circuit of the preferred embodiment of the present invention as used on a lift truck.

Referring now to FIG. 1, a first motor generally indicated by the reference numeral 12 consists of a first hydraulic piston and cylinder assembly 14 and a second hydraulic piston and cylinder assembly 16 which actuate clamps 18 and 20 of a fork lift clamp. A pair of lines 22 and 24 are connected to the first motor 12 for actuating the double acting motor 12.

A second motor 26 may include a hydraulic piston and cylinder assemby and be connected to the conventional pivot or side shift mechanism of a lift truck. Of course, the lines 27 and 28 may be connected, as is conventional, to the motor 12 to form an internal side shift whereby the motor 12 acts both as a clamping motor and as a side shift motor. A pair of lines 27 and 28 are connected to the second motor 26 for communicating fluid to and from the motor 26 for actuation. A third motor 30 which may be a reversible hydraulic motor, rotates in either direction depending upon the direction of flow in its connected pair of lines 32 and 34. The motor 30 may be used as the rotation motor in a lift truck.

Generally, the above description of motors on the carriage of a lift truck is conventional. However, the carriage moves relative to the truck and the fluid power source and controls are positioned on the truck. This requires that hydraulic lines extend through conventional hose reels between the truck and the carriage and it is therefore important to keep the number of hydraulic lines to a minimum.

The power system 10 of the present invention provides a simple, but effective way of selectively and individually actuating each of the motors 12, 26 and 30 from a fluid power source 40 such as a pump with only four lines.

The present power system 10 includes a first function valve 42 which may be any suitable valve such as a manually operated three position four-way valve which is connected between the fluid power source 40 and sump 44. Preferably the valve 42 is spring-loaded to a neutral position 46 and is manually actuated to connect position 48 or 50 to the fluid source 40 and sump 44. The valve 42 has its output connected to a pair of hydraulic power lines 52 and 54 which are connected to the fluid lines 22 and 24 of the first motor 12, preferably through conventional pilot operated check valves 56 and 58. Thus, actuation of the first function valve 22 will actuate the first motor 12. For example, assuming the valve 42 is actuated to place position 48 between the inlets and outlets of the valve fluid will flow through line 52 into motor line 22 to cause the clamps 18 and 20 to move together and expel fluid through motor line 24 to power line 54 and to the sump 44. Conversely, the valve 42 is actuated in the reverse direction to bring position 50 between the inlets and outlets, and fluid will be supplied to power line 54 and motor line 24 to cause the clamps 18 and 20 to move apart while venting hydraulic fluid through motor line 22 and power line 52 to the sump 44. Power lines 52 and 54 extend from the truck to the carriage.

A second function valve 60 is provided having its input connected to the power source 40 and sump 44 and having its output connected to fluid power lines 62 and 64 leading to the carriage for supplying the power for actuating either the second motor 26 or the third motor 30. The valve 60 may be any suitable valve and may be similar to valve 42 and includes positions 66, 68 and 70. In order to selectively connect the power lines 62 and 64 to one of the motors 26 and 30, a selector valve 70 is provided which may be any suitable valve such as a six-way, two positioned spring return and hydraulically piloted valve. The input to the valve 70 is connected to the power lines 62 and 64 and the outputs are connected to fluid motor lines 27 and 28 leading to motor 26 and to fluid motor lines 32 and 34 connected to motor 30. The valve 70 has positions 72 and 74. The valve position 72 when positioned between the valve input and output motor 30 is connected to the power lines 62 and 64 and thus motor 30 can be controlled in either a forward or reverse direction by actuation of the second function valve 60. When position 74 of the selector valve 70 is placed between the input and output of valve 70, the fluid motor lines 27 and 28 of the motor 26 are connected to the fluid power lines 62 and 64 and can be controlled in either a forward or reverse direction by actuation of the second function valve 60. The pilot control line 80, which is connected to the selector valve 70, is connected to one of the power lines 52 and 54 and is preferably connected to the closing or holding line 52. The pilot control line is entirely on the carriage of the lift truck and thus only the fluid power lines 52, 54, 62 and 64 need extend between the truck and the carriage.

In order to actuate the selector valve 70 through the pilot control line 80, a control valve 90 is provided on the truck connected between the fluid power source 40 and the power line to which the pilot control line 80 is connected, such as 52, through a control line 92. The valve 90 may be any suitable valve such as a three-way, two position valve which may be actuated by any suitable means such as manually, electrically, or hydraulically, here shown as manually actuated. The valve 90 has positions 94 and 96 in which 94 shuts off communication between the power source 40 and the line 52 and provides a return to a suitable sump 98 or 44. When position 96 is moved to between the input and the output of the valve 90, fluid power from the power source 40 is transmitted to the line 52 and to pilot control line 80 for actuating the selector switch 70. A restrictor 100 is provided in the control line 92 for limiting the venting of fluid from line 52 to the sump 98.

In operation, the first function valve 42 may be selectively actuated to control the first motor 12 for moving the clamps 18 and 20 to pick up or release a load. While the application of power fluid to the line 52 will cause the actuation of the selector switch 70, the second motor 26 and the third motor 30 are not actuated so long as the second function valve 60 is in the neutral position 66. When it is desired to actuate the third motor 30, the second function valve 60 is actuated at a time while the first function valve 42 and the control valve 90 are in the deactuated position. When it is desired to actuate the second motor 26, the control valve 90 is actuated to supply fluid from the power source 40 through the power line 52 and the pilot control line 80 to shift the selector valve 70 and then valve 60 is actuated to control the direction of movement of the second motor 26. It is to be noted that the application of power through the control valve 90 to the power line 52 will not adversely affect any load engaged by the first motor 12 as it merely applies a holding force to the first motor 12 similar to the holding force already applied to the load.

The present invention, therefore, allows selective actuation of the motors 12, 26 and 30 but only requires four hydraulic lines 52, 54, 62 and 64 to extend between the truck and the movable carriage.

Figure 2:
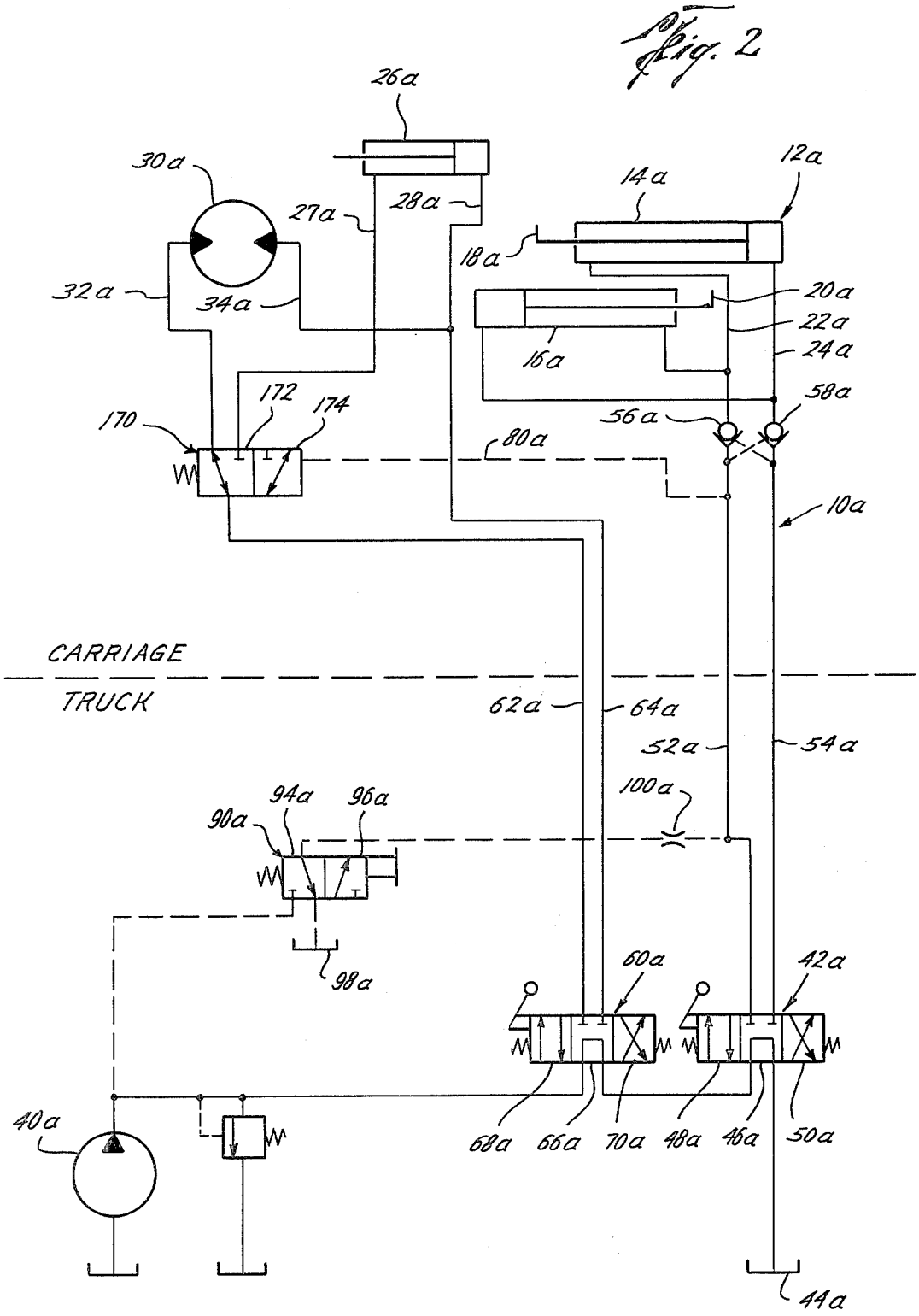
FIG. 2 is a schematic hydraulic circuit of another embodiment of the present invention as used on a lift truck.

A further embodiment of the present invention is best seen in FIG. 2 wherein like parts are numbered similarly to those in FIG. 1 with the addition of the suffix "a". The embodiment of FIG. 2 is identical to the embodiment of FIG. 4 with the exception that one of the power lines from the second function valve **60*a*, such as line 64*a*, is connected directly to the second motor 26*a* and the third motor 30*a* such as to lines 28*a* and 34*a*, respectively. In addition, a two-position, three-way valve 172 is substituted for the six-way valve 72 and is connected between the second power line, such as 62*a*, and selectively controls the actuation of the second motor 26*a* and the third motor 30*a* by being selectively connected to lines 27*a* and 32*a***, respectively.

In operation, the first motor **12*a* is again controlled in either the full forward or reverse direction by actuation of the first function valve 42*a*. The third motor 30*a* is actuated in the forward or reverse direction by the second function valve 60*a* when position 170 of valve 172 is positioned, as shown in FIG. 2, between the power line 62*a* and the line 32*a*. When the selector valve 172 is shifted by actuation of the control valve 90*a* to bring position 174 of the selector valve 172 into position between the line 62*a* and the line 27*a*, the second motor 26*a* is actuated in the forward or reverse direction by actuation of the second function valve 60*a*. Again, in this embodiment in FIG. 2, only four hydraulic lines 52*a*, 54*a*, 62*a*, and 64*a*** extend between the truck and the carriage.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts, will readily suggest themselves to those skilled in the art and which are encompassed within the spirit of the invention and the scope of the appended claims.

What is claimed is:

1. A fluid power system having a fluid power source for actuating three separately controllable reversible fluid motors each for selectively providing a separate function and each having a pair of fluid lines comprising, a first function valve connected between the power source and the pair of lines connected to the first motor, a second function valve connected between the fluid source and a pair of power lines, a selector valve connected to at least one of the power lines for receiving fluid therefrom and connected to at least one of the lines connected to each of the second and third motors for selectively connecting one of the second and third motors to the power lines, a pilot control line connected between one of the pair of lines to the first motor and to said selector valve for actuating the selector valve, and a control valve connected between a fluid source and said one of the pair of lines to the first motor for supplying fluid to and actuating the selector valve.

2. A fluid power system having a fluid power source for actuating three separately controllable reversible fluid motors each for selectively providing a separate function and each having a pair of fluid lines comprising, a first function valve connected between the power source and the pair of lines connected to the first motor, a second function valve connected between the fluid source and a pair of power lines, one of said power lines connected to the second and third motors, a selector valve connected to the second power line for receiving fluid therefrom and connected to the second and third motors for selectively connecting one of the second and third motors to the second power line, a pilot control line connected between one of the pair of lines to the first motor and to said selector valve for actuating the selector valve, and a control valve connected between a fluid source and said one of the pair of lines to the first motor for supplying fluid to and actuating the selector valve.

3. A fluid power system having a fluid power source for actuating three separately controllable reversible fluid motors each for selectively providing a separate function and each having a pair of fluid lines comprising, a first function valve connected between the power source and the pair of lines connected to the first motor, a second function valve connected between the fluid source and a pair of power lines, a selector valve connected to the power lines for receiving fluid therefrom and connected to the pairs of lines connected to the second and third motors for selectively connecting said pairs of lines to the second and third motors to the power lines, a pilot control line connected between one of the pair of lines to the first motor and to said selector valve for actuating the selector valve, and a control valve connected between a fluid source and said one of the pair of lines to the first motor for supplying fluid to and actuating the selector valve.

4. The apparatus of claim 3 wherein the selector valve is a six-way, two positioned hydraulically controlled pilot valve.

5. The apparatus of claim 4 including, a restrictor between the control valve and said one of the pair of lines.

6. The apparatus of claim 3 wherein the first motor is a clamping motor and the said one of the pair of lines to the first motor is the closing line.

7. In a lift truck having a truck body and a movable carriage in which a fluid power source is mounted on the body and three separately controllable reversible fluid motors each for selectively providing a separate function and each having a pair of fluid lines are mounted on the carriage, the improvement in a fluid power system having only four hydraulic fluid lines connected between the body and the carriage comprising, a first function valve mounted on the body and connected between the power source and a pair of hydraulic power lines connected to the first motor, a second function valve mounted on the body and connected between the power source and a second pair of power lines extending to the carriage, a selector valve mounted on the carriage and connected to the second pair of power lines for receiving power fluid therefrom and connected to the pairs of lines connected to the second and third motors for selectively connecting said pairs of lines to the second and third motors to the power lines, a pilot control line on the carriage connected between one of the pair of lines to the first motor and to said selector valve for actuating the selector valve, and a control valve mounted on the body and connected between the power source and said one of the pair of lines connected to the first function valve for supplying fluid to and actuating the selector valve.

8. In a lift truck having a truck body and a movable carriage in which a fluid power source is mounted on the body and three separately controllable reversible fluid motors each for selectively providing a separate function and each having a pair of fluid lines are mounted on the carriage, the improvement in a fluid power system having only four hydraulic fluid lines connected between the body and the carriage comprising, a first function valve mounted on the body and connected between the power source and a pair of hydraulic power lines connected to the first motor, a second function valve mounted on the body and connected between the power source and a second pair of power lines extending to the carriage, one of said power lines connected to the second and third motors, a selector valve mounted on the carriage and connected to the second power line for receiving power fluid therefrom and connected to the second and third motors for selectively connecting one of the second and third motors to the second power line, a pilot control line on the carriage connected between one of the pair of lines to the first motor and to said selector valve for actuating the selector valve, and a control valve mounted on the body and connected between the power source and said one of the pair of lines connected to the first function valve for supplying fluid to and actuating the selector valve.

* * * * *